United States Patent [19]

Kasuga

[11] 4,084,523

[45] Apr. 18, 1978

[54] CAM SELECTING DEVICE FOR A SEWING MACHINE

[75] Inventor: Norboru Kasuga, Hachioji, Japan

[73] Assignee: Janome Sewing Machine Co. Ltd., Tokyo, Japan

[21] Appl. No.: 711,078

[22] Filed: Aug. 2, 1976

[30] Foreign Application Priority Data

Aug. 11, 1975 Japan ..... 50-97970

[51] Int. Cl.[2] ..... D05B 3/02

[52] U.S. Cl. ..... 112/158 A

[58] Field of Search ..... 112/158 A, 158 R, 158 D

[56] References Cited

U.S. PATENT DOCUMENTS

| | | | |
|---|---|---|---|
| 2,971,482 | 2/1961 | Kolke | 112/158 A |
| 3,067,702 | 12/1962 | Shimada | 112/158 A |
| 3,699,910 | 10/1972 | Urciola et al. | 112/158 A |
| 3,820,485 | 6/1974 | Bradus et al. | 112/158 A |

*Primary Examiner*—Werner H. Schroeder

*Assistant Examiner*—Peter Nerbun

*Attorney, Agent, or Firm*—Michael J. Striker

[57] ABSTRACT

A sewing machine has a drive shaft that rotates relative to the machine frame in order vertically to reciprocate a needle and to rotate a pack of pattern cams. A cam follower is displaceable along this pack and engageable with each of the cams for controlling the stitch pattern of the machine needle. A rotatable dial carried on the machine serves both to displace the cam follower from a position engaging one of the cams into a disengaged position clear of the cams, and for displacing this follower along the pack of cams. On rotation of the dial the cam follower is first lifted off the cams and only then is it displaced along the pack. Once lifted off the pack the cam follower is held away from the pack until either the dial is depressed so as to automatically to release it from its disengaged position, or the sewing machine is operated so that the rotating drive shaft of the machine automatically releases the cam follower when it attains a predetermined angular position.

19 Claims, 32 Drawing Figures

CAM SELECTING DEVICE FOR A SEWING MACHINE

BACKGROUND OF THE INVENTION

This invention relates to a cam selecting device for sewing machines, in which a single operating member is operated to release cam follower from the pattern cam, to shift the cam follower along the packs of cams, and to select a desired pattern cam, thereby to simplify the selection of pattern cams as well as to provide exactly high stitching efficiency.

There have been proposed various kinds of cam selecting devices for a zigzag sewing machine. One example is that two operating dials or buttons are provided for the operator first to push a follower-releasing button with one hand and then to move the follower and select a desired pattern cam by means of the other dial or button with the other hand, this being the so-called two-hand operating system. Such operations are disadvantageous per se, since the releasing button must be continuously pushed usually heavily and the selecting dial is often forcibly rotated by error when the follower is not released or not fully released, resulting in the breakage of the sewing machine.

Another example is that a releasing dial is rotated to set the follower at the released position, and in the meantime another dial moves the follower. In this operation, the manipulation of the operating members is complicated and the operation to cancel the released condition of the follower is often neglected or forgotten.

A further example is that one dial is pushed or pulled to release the followers and the dial is rotated to select a desired cam while maintaining the follower in the released condition with one hand. In this case, the follower releasing pressure is quite heavy, and the dial is often rotated while the follower is not fully released, resulting in disorder of the sewing machine.

A still further example is that the release of a follower and the selection of a pattern cam are carried in one step by rotation of one dial. The rotation angle of the dial is, however, extremely large, since after the follower is released, it is moved and the released condition of the follower is cancelled. Therefore, relative to the pack of built-in pattern cams, the rotation angle of the dial is quite large and the cam selecting operation is difficult.

As above mentioned, the conventional devices have defects and disadvantages and lack in industrial utility.

SUMMARY OF THE INVENTION

The invention has been devised to remove such defects and disadvantages of the prior art. A fundamental object of the invention is to simplify handling of the sewing machine by means of one operating member for releasing and shifting cam followers as well as engaging the released cam followers to the desired pattern cams.

Another object of the invention is to release the followers from the pattern cams by a first rotation of the operating member to shift the followers along the pack of built-in cams by a second rotation thereof to select desired pattern cams and to cancel the released condition of the followers by pushing it, thereby increasing sewing efficiency.

A further object of the invention is to select desired pattern cams of a number of pattern cams packed in the machine housing by means of a simplified mechanism.

Other features and characteristics of this invention will be apparent from the following explanation of the invention with reference to the attached drawings.

DETAILED EXPLANATION OF THE INVENTION

Figure 1:
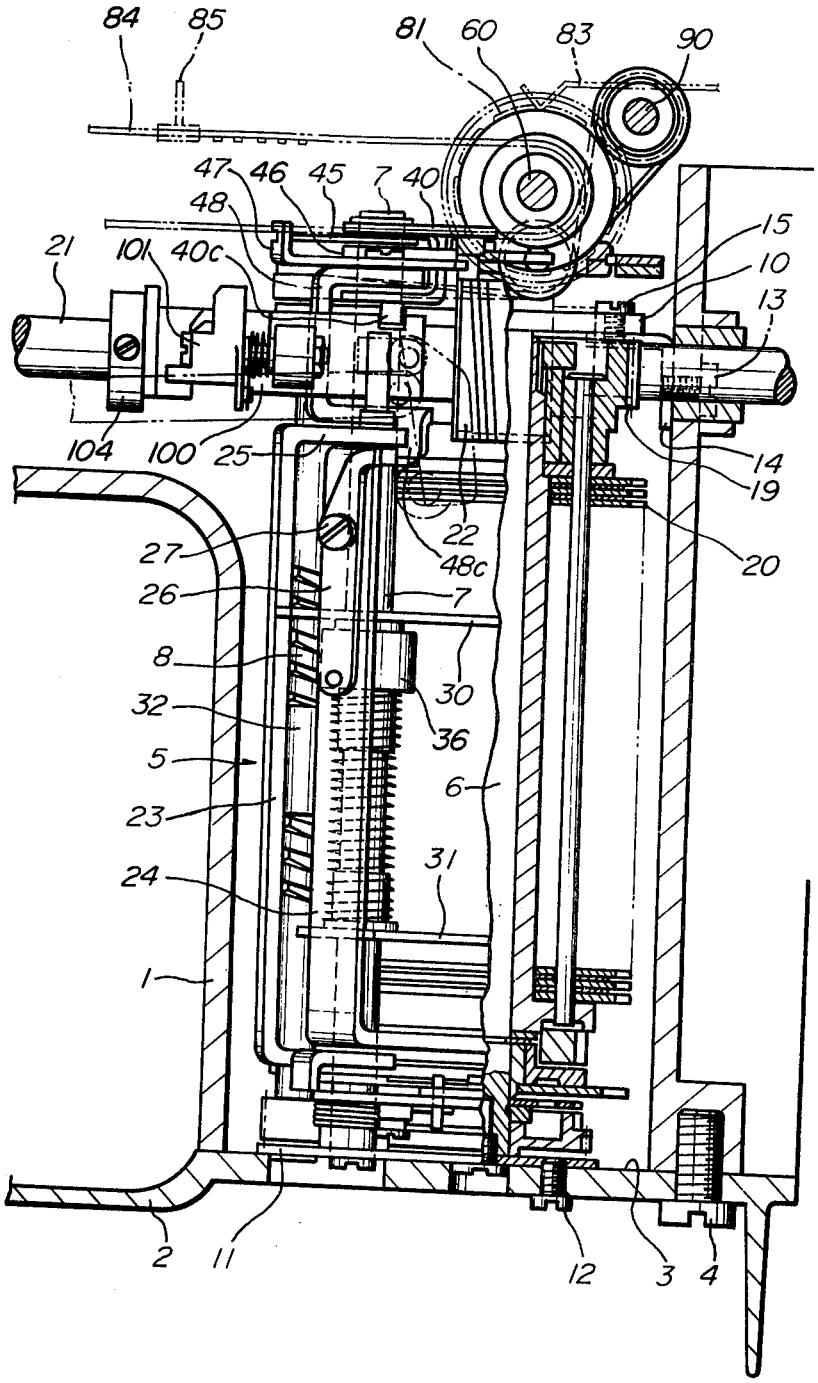
FIG. 1 is a front elevational view of a sewing machine provided with this invention shown partly in a vertical section.
Figure 2:
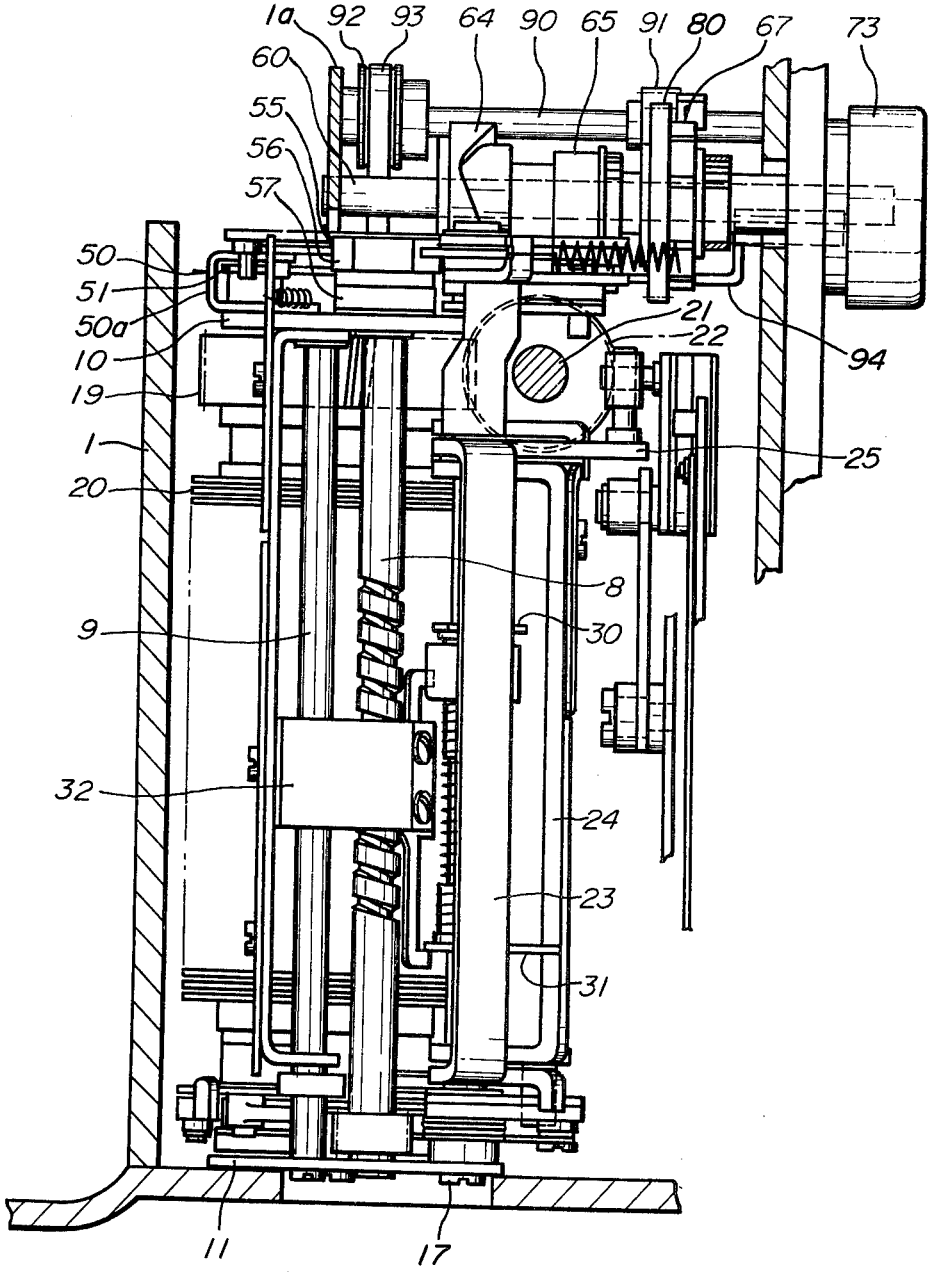
FIG. 2 is a side elevational view of FIG. 1 shown partly in a vertical section.
Figure 3A:
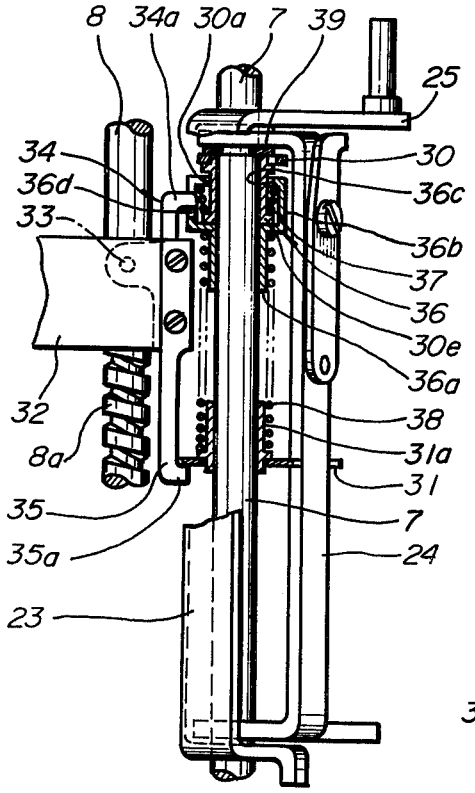
FIG. 3(A) is a front elevational view of this invention partly shown in which a moving element is moved to the upper position.
Figure 6:
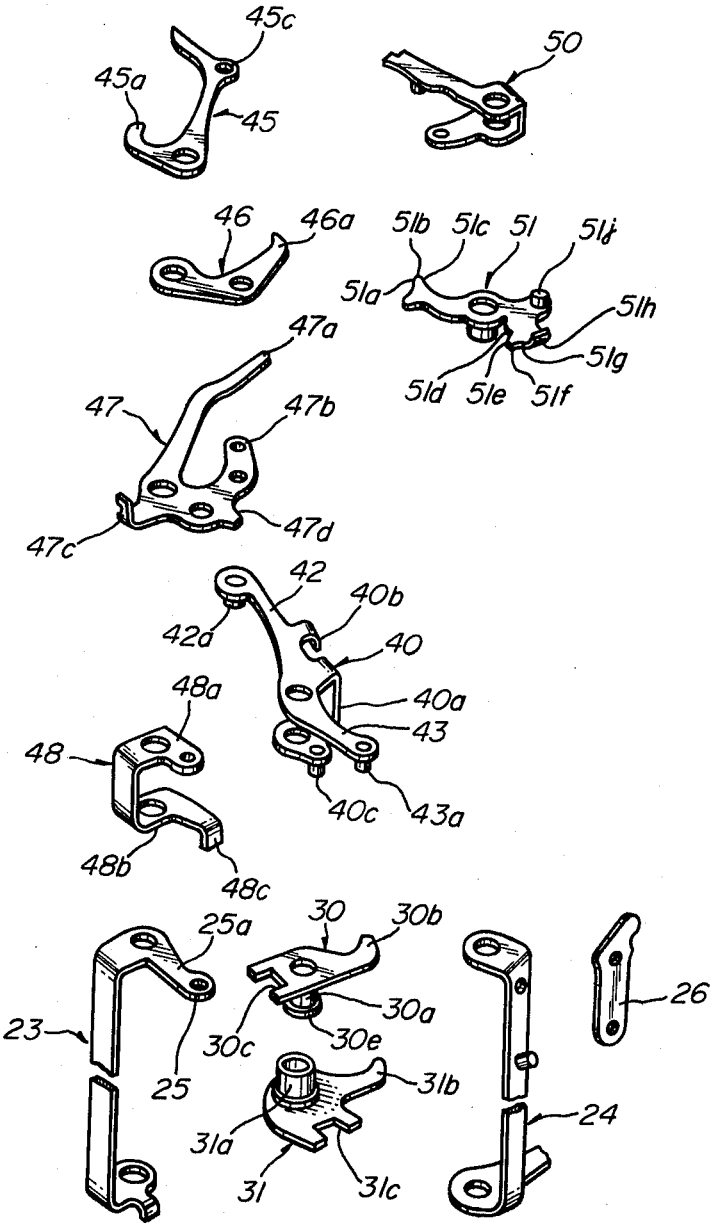
FIG. 6 is an exploded perspective view of a cam selecting device of this invention.
Figure 26:
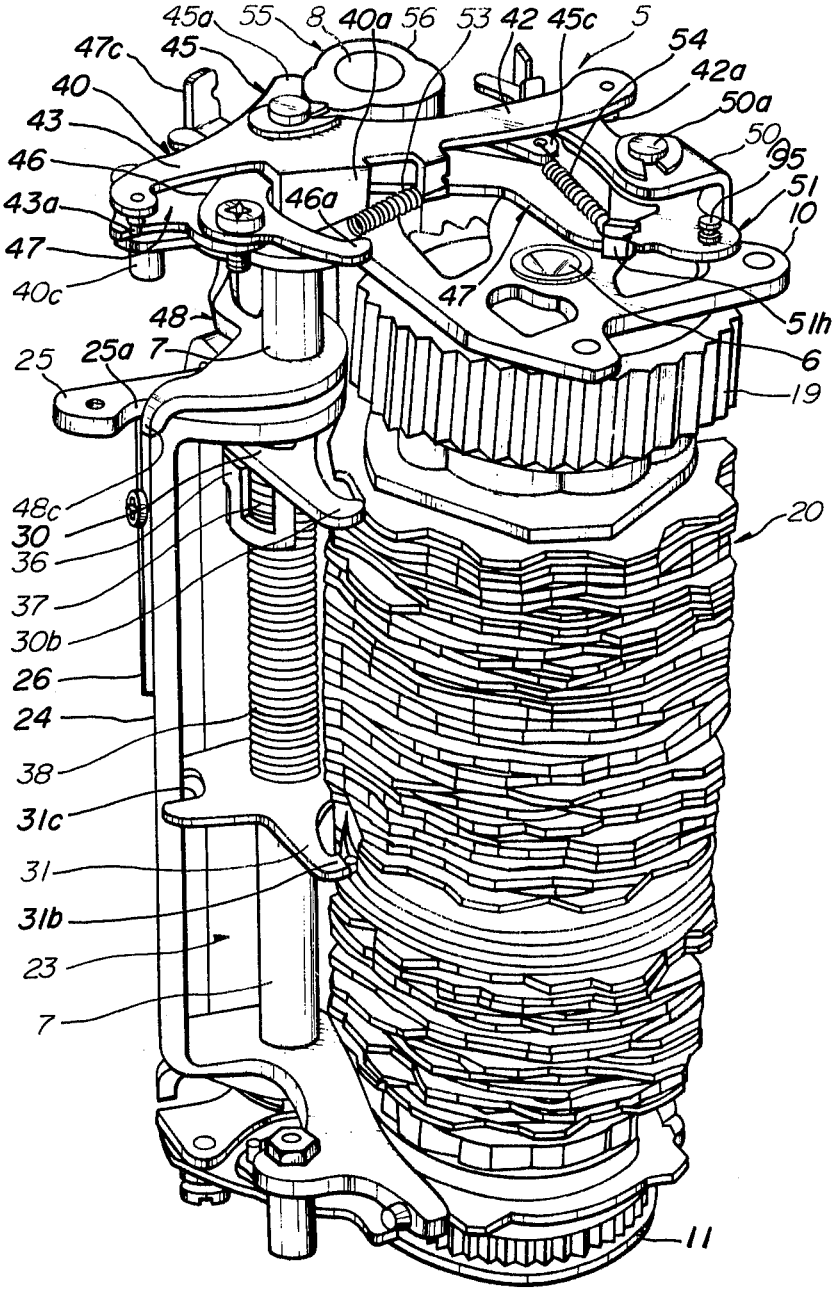
FIGS. 26 and 27 are perspective views of the cam selecting device of this invention.
Figure 27:
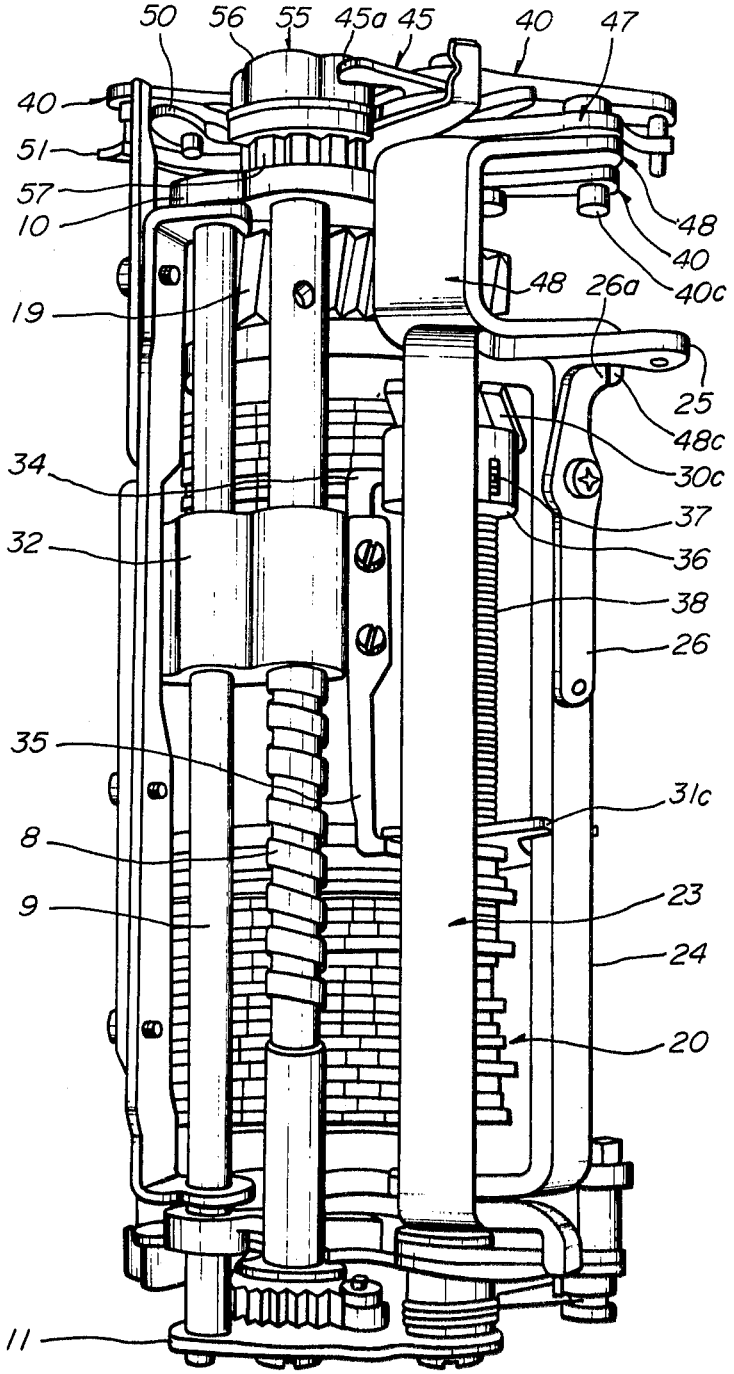
Figure 28:
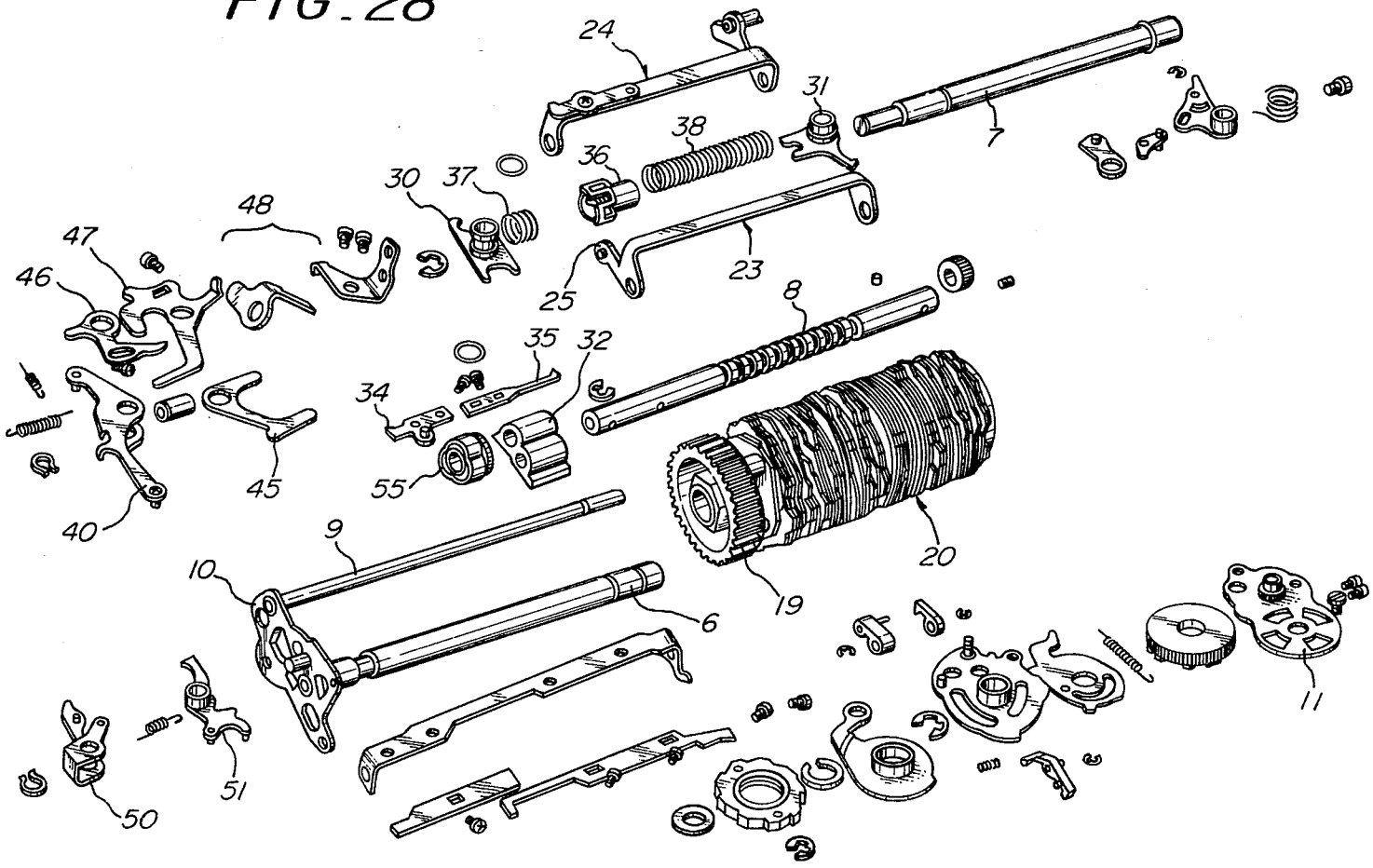
FIG. 28 is an exploded perspective view of the cam selecting device.

Referring to FIGS. 1 and 2 reference numeral 1 is a standard of a sewing machine positioned on the support face 3 of a machine bed 2 and fixed thereto by means of screws 4, one of which is seen. Numeral 5 is a mechanism unit of a cam selecting device and is composed of an upper plate 10, a lower plate 11, and between the two plates, there are arranged a cam shaft 6, a follower shaft 7, a feeding screw shaft 8 and guide shaft 9. The mechanism unit 5 is vertically arranged in the standard, and the lower plate 11 is fixed to the support face 3 of the machine bed by means of screws 12, one of which is seen, and the upper plate 10 is secured to a bracket 14 by means of screws 15, one of which is seen. The bracket 14 is fixed to the standard 1 by means of a screw 13. The cam shaft 6 and follower shaft 7 are fixedly supported between the upper and lower plates 10, 11, and the guide shaft 8 is rotatably supported between the two plates. As illustrated in FIGS. 26–28, on the cam shaft 6 is rotatably mounted a unit of a worm wheel 19 and a plurality of packed pattern cams 20 including feed control cams. The unit is prevented from shifting vertically on the cam shaft. The worm wheel 19 engages a worm 22, as illustrated in FIGS. 1 and 2, which is mounted on an upper shaft 21 rotatably supported to the machine arm 1, and is rotated with the upper shaft 21. Thus the unit of the worm wheel 19 and the packed pattern cams 20 is rotated in a reduced speed in the clockwise direction in reference to FIGS. 26 and 27. As illustrated in FIGS. 1–4, numerals 23, 24 are U-shaped plates which are turnably mounted on the follower shaft 7 and prevented from moving in the axial direction. The U-shaped plate 24 is positioned within the U-shaped plate 23. The plate 23 is in association with a needle control follower 30 and the plate 24 is in association with a feed control follower 31 as illustrated in FIG. 26. The U-shaped plate 23 is formed with a horizontal projection 25 at the top thereof, and the U-shaped plate 24 has an engaging element 26 attached thereto by means of screw 27 at the upper part thereof. The engaging element 26 has a projection 26*a* adjacent the horizontal projection 25 of the U-shaped plate 23 as illustrated in FIG. 1. As illustrated in FIGS. 3(A) and 26 the followers 30, 31 have bosses 30*a*, 31*a* respectively and turnably mounted on the follower shaft 7. These followers 30, 31 have pawls 30*b*, 31*b* respectively at one end thereof for engaging the pattern cams 20 and feed control cams respectively and have forked ends 30*c*, 31*c* respectively at the other end thereof for engaging the vertical parts of the U-shaped plates 23, 24 respectively as illustrated in FIGS. 6, 26 and 27. The followers 30, 31 are pressed to one of the pattern cams 20 and one of the feed control cams respectively by means of respective springs (not shown).

Figure 3B:
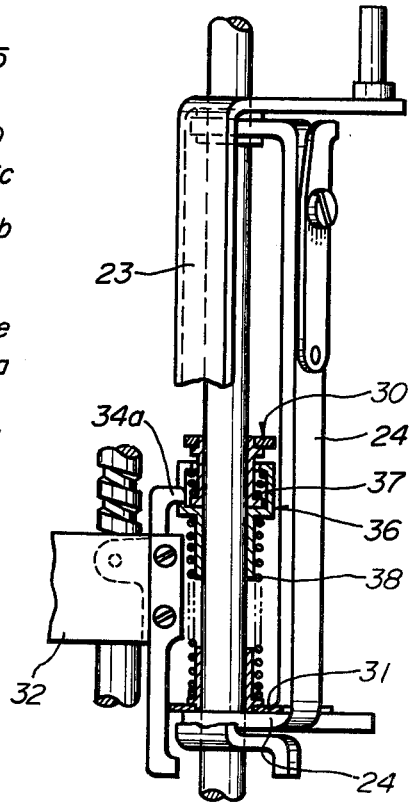
FIG. 3(B) is the same as FIG. 3(A) but the moving element is moved to the lower position.
Figure 3C:
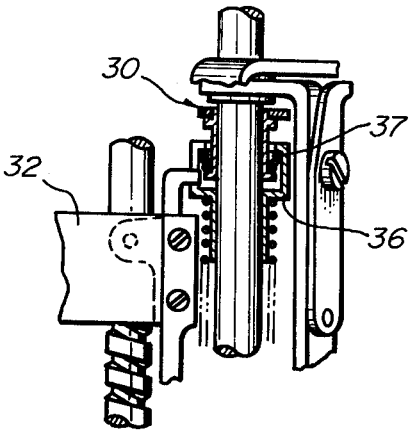
FIG. 3(C) is a front elevational view of this invention partly shown in which a spring receiving element presses a frist compression spring.
Figure 3D:
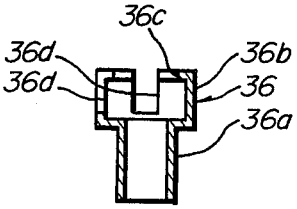
FIG. 3(D) is a front elevational view of the spring receiving element shown in a vertical section.
Figure 4:
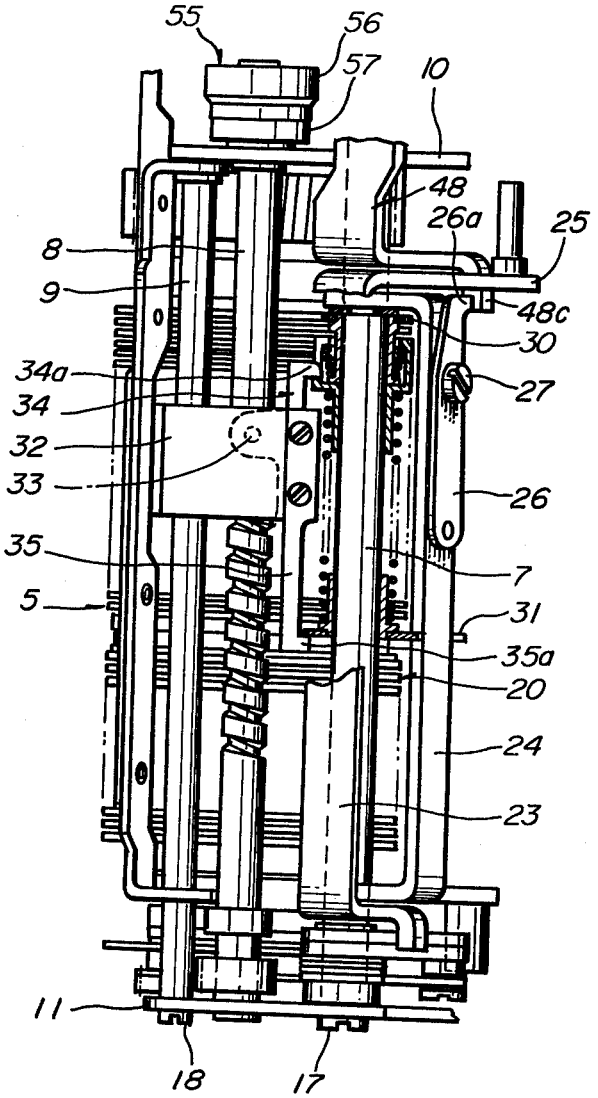
FIG. 4 is a front elevational view of a cam selecting device of this invention.
Figure 5:
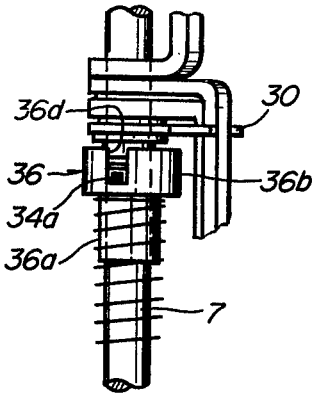
FIG. 5 is a front elevational view showing the spring receiving element mounted on the cam selecting device.

As illustrated in FIGS. 2, 3(A)–3(C) and 28, numeral 32 is a moving element slideably mounted at one end thereof on a vertical shaft 9 fixedly arranged between the upper plate 10 and the lower plate 11 in parallel with the guide shaft 8. Since the moving element 32 is equipped with a pin 33 laterally extending on the inner face thereof for engaging a thread groove 8*a* of the guide shaft 8. It is moved in the axial direction in accordance with rotation of the guide shaft 8. The moving element 32 has plates 34, 35 attached to the other end thereof. These plates have engaging parts 34*a*, 35*a* respectively. A capsule 36 is slidably mounted on the followers shaft 7 between the follower 30 for the pattern cams and the follower 31 for the feed control cams. The capsule has a central boss 36*a* and an enlarged upper cylindrical portion 36*b* with a flange 36*c* around at the top thereof. The cylindrical portion 36*b* is formed with vertical cut-outs 36*d* as illustrated in FIG. 3D, and receives the boss 30*a* of the follower 30 having a lower flange 30*e* as illustrated in FIG. 6.

A compression spring 37 is positioned around the boss 30*a* of the follower 30 and between the flange 36*c* of the capsule 36 and the flange 30*e* of the boss 30*a* of the follower 30. Another compression spring 38 is positioned around the follower shaft 7 and between the capsule 36 and the lower follower 31. The engaging part 34*a* of the plate 34 on the moving element 32 engages one of the cut-outs 36*d* of the capsule 36, and the engaging part 35*a* of the plate 35 is adapted to engage the underside of the lower follower 31 for the feed control cams of the pattern cams 20. Accordingly, when the guide shaft 8 is rotated, the moving element 32 is axially moved and the followers 30, 31 are also axially moved via the moving plates 34, 35 and the capsule 36. If the moving element 32 is moved upwardly as shown in FIG. 3(A), the follower 30 contacts a stop ring 39 fixedly mounted on the follower shaft 7 at the upper part thereof, and stops there, but the lower follower 31 continues to move a little upwardly against the action of the compression spring 38. FIG. 3(B) shows that the moving element 32 moves downwardly, and in this case the lower follower 31 is stopped by contacting the lateral extension of the U-shaped plate 24, but the upper follower 30 continues to move a little downwardly against the action of the compression spring 38. In either case, the first compression spring 37 is not influenced by the second compression spring 38. However when the upper follower 30 is urged to move when it is not completely separated from one of the pattern cams 20 during its downward movement, only the capsule 36 is moved while compressing the first compression spring 37 as shown in FIG. 3(C) and the follower 30 does not move but remains there. When the machine is then manually rotated to rotate the cam adjacent the follower 30 and the recessed portion of the cam aligns with the follower, the follower is shifted by the compression spring 37.

Figure 8:
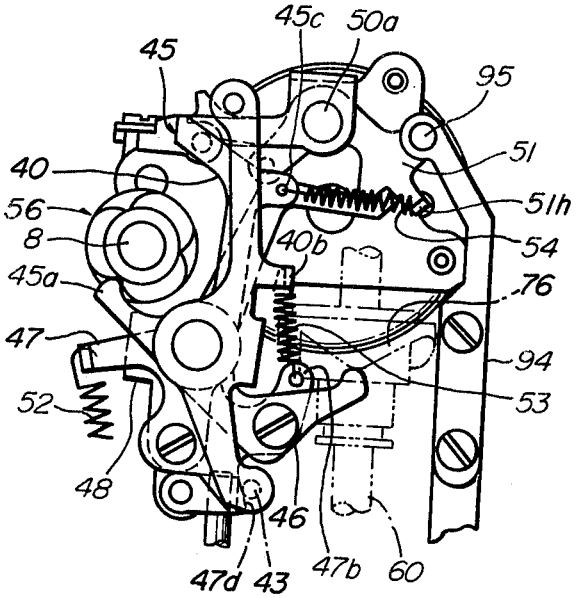
FIGS. 8 to 11 are partial explanatory views of the cam selecting device.
Figure 10:
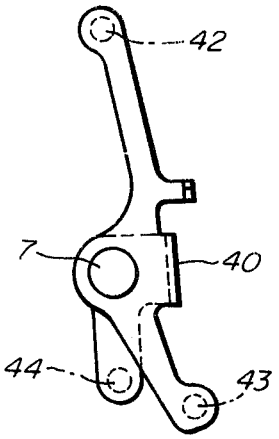
Figure 9:
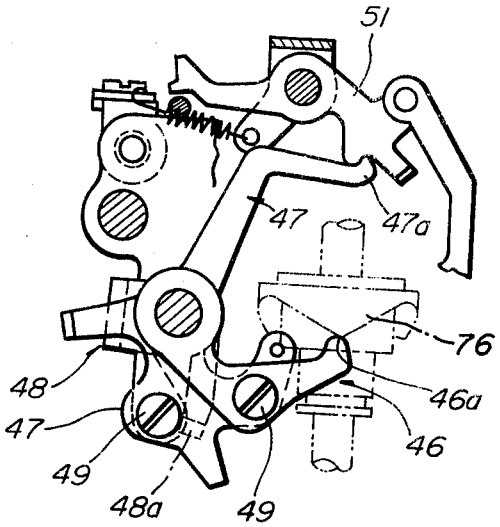
Figure 11:
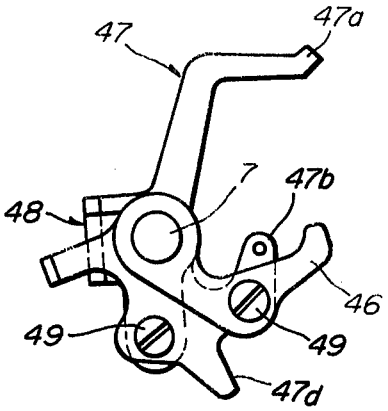

As illustrated in FIGS. 1, 6, 26 and 27, numeral 40 is an actuating level having arms 42, 43, U-shaped arm 40*a* and projection 40*b* on the arm 42 and is turnably mounted on top of the follower shaft 7 passing through the upper base plate 10. Pins 40*c*, 42*a*, 43*a* are attached to the free ends of the U-shaped arm 40*a*, and of the arms 42 and 43 respectively as shown. Within the U-shaped arm 40*a* of the arm 40 there are turnably mounted on the follower shaft 7 in order from the top a recovering arm 45, a releasing plate 46, a holding lever 47 and a U-shaped releasing arm 48. The recovering arm 45 has a follower 45*a*; the releasing plate 46 has a follower 46*a*; the holding lever 47 has arms 47*a* and 47*b* and projections 47*c* and 47*d*; and the U-shaped releasing arm 48 has a depending projection 48*c* as shown in FIG. 6. As illustrated in FIGS. 8, 9 and 11, the releasing plate 46 is connected to the arm 47*b* of the holding lever 47, and the holding lever is connected to the releasing arm 48 respectively by means of screws 49 and 49, so that the releasing plate 46, the holding lever 47 and the releasing arm 48 may be turnable with each other in a unit.

As illustrated in FIGS. 1 and 27, the U-shaped releasing arm 48 straddles the upper base plate 10, and the upper part 48*a* of the arm 48 is loosely mounted on the extended follower shaft above the base plate 10 and the lower part 48*b* is also loosely mounted on the follower shaft 7 below the base plate 10.

Figure 7:
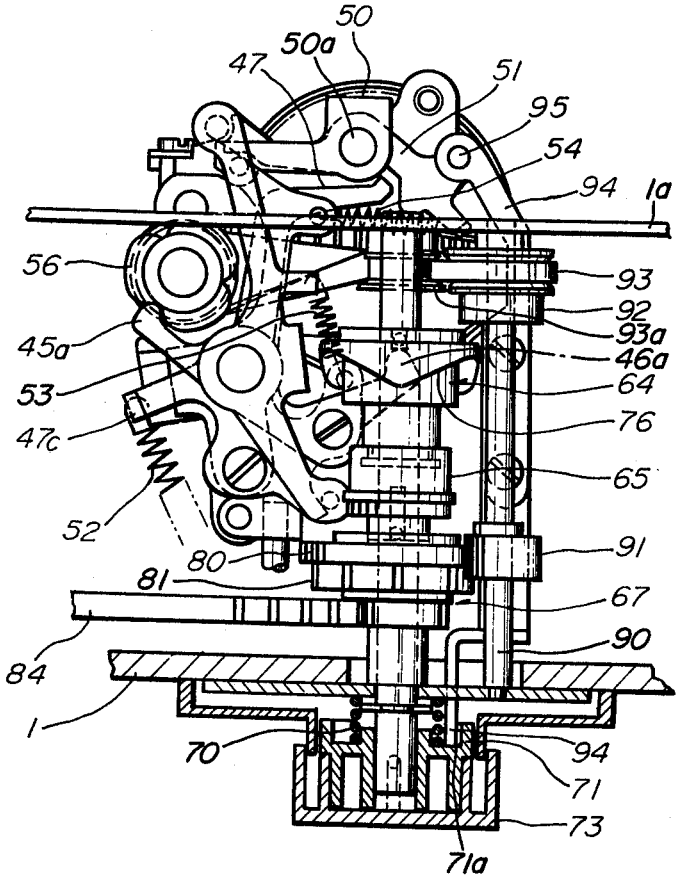
FIG. 7 is a sectional plan view of the upper part of the cam selecting device.

Numeral 50 is a U-shaped member turnably mounted as seen in FIG. 7 on the upper base plate 10 by means of a pin 50*a* at a position remote from the upper extended portion of the follower shaft 7. A holding plate 51 is turnably mounted on the pin 50*a* within the U-shaped member 50, and has engaging portions 51*a*–51*h* and an upper projection 51*j* as illustrated in FIG. 6.

Figure 14:
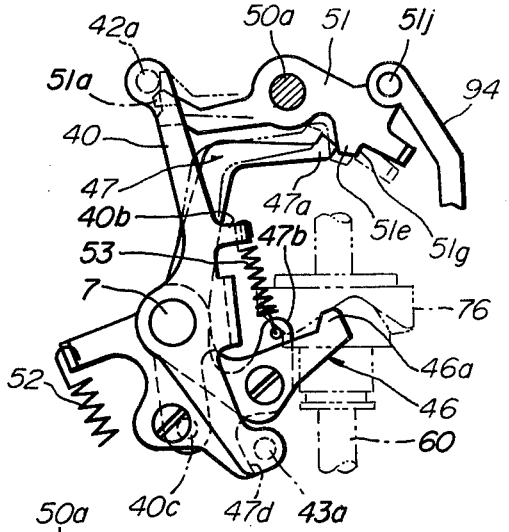
FIGS. 14 and 15 are explanatory views of a part of the cam selecting device.

As illustrated in FIGS. 7 and 8, a tension spring 52 is at one end connected to the projection 47*c* of the holding lever 47 and is at the other end anchored to a machine housing 1, so that the unit of the releasing plate 46, holding lever 47 and the releasing arm 48 is pulled in the counter-clockwise direction. A tension spring 53 is at one end connected to the depending projection 40*a* of the actuating lever 40 and at the other end anchosed to the arm 47*b* of the holding lever 47 so that the actuating lever is pulled in the clockwise direction. Thus, the pin 43*a* of the actuating lever 40 is pressed against the projection 47*d* of the holding lever 47 as shown in FIGS. 7, 8 and 14. Accordingly the actuating lever 40 is together with the unit of releasing plate 46, holding lever 47 and releasing arm 48 pulled in the counter-clockwise direction by the tension spring 52. A tension spring 54 is at one end connected to the projection 51*h* of the holding plate 51 and is at the other end connected to the hole 45*c* of the recovering arm 45 so as to pull the recovering arm 45 in the clockwise direction. A sprocket body composed of an indexing cam 56 and a sprocket 57 which are mounted on the top of the guide shaft 8 projected from the upper plate 10 as illustrated in FIG. 27. The indexing cam 56 is engaged by the follower 45*a* of the recovering arm 45 biased by the spring 54.

In FIGS. 7, 12A, 12B and 13, a dial shaft 60 is rotatably mounted across machine frame 1. A disk 62 is mounted on the dial shaft and is prevented from rotation retative to the shaft 62 by means of a pin 61 passing through the shaft and a slot 62*a* in the disk. Adjacent the disk 62, a releasing cam body 64 composed of a cam 76 and a boss 76*a* is mounted on the dial shaft 60 and is axially slidable. A compression spring 63 is mounted around the dial shaft between the disk 62 and the releasing cam body 64. A clutch member 65 is mounted on the dial shaft 60 adjacent the releasing cam body 64. The clutch member 65 is, as shown, axially movable and prevented from rotation relative to the dial shaft 60 by means of a pin 66 fixed on the shaft 60. The clutch member 65 has a pair of ears 65*a* at one end thereof which engage a groove 77 formed around the boss 76*a* of the releasing cam body 64. A rotary member 67 is loosely mounted on the dial shaft 60 and is prevented from axial movement by means of a stop ring 68 fixed to the shaft 60.

The releasing cam body 64 is formed with radial grooves 75 around the counter-bore thereof to engage the pin 61. On one end part of the dial shaft 60 protruding out of the machine frame 1, a dial member 71 is mounted. The dial member is connected to the dial shaft 60 by means of a pin 72 fixed to the dial shaft, and the dial member is axially shiftable. A compression spring 70 is provided around the dial shaft 60 between the dial member face 71*a* and the machine frame. A dial cover 73 is fitted onto the dial member 71. The dial member 71 is formed with axial projections 71*b* and recesses 71*c* which cooperate with an exial projection 97 fixed to the machine frame 1, so that the dial member may be prevented from axial movement at indefinite angular positions even if it is pushed. The cam 76 of the releasing cam body 64 is engaged by the follower 46*a* of the releasing plate 46 biased by the tension spring 52. The rotary body 67 is formed with radial grooves 79 around the counter-bore thereof to receive radial projections 78 of the clutch member 65. The grooves 79 of the rotary body 67 are aligned with the grooves 75 of the releasing cam body 64. The rotary body 67 is formed with a gear 80. A indexing cam 81 and a sprocket 82 therearound.

In FIG. 1, a leaf spring 83 is at one end fixed to the machine frame 1 and is at the free end thereof engaged with the indexing cam 81 of the rotary member 67.

A belt 84 is wound around the sprocket 82 of the rotary member 67 and a pattern indicator 85 is secured on the belt 84. In FIGS. 2 and 7, a transmission shaft 90 is rotatably mounted between the machine frame 1 and a bracket 1*a* fixed to the machine frame adjacent the dial shaft 60, and a small gear 91 is fixed on the shaft 90 at the forward part thereof. The small gear 91, engages the gear 80 on the dial shaft 60. A sprocket 92 is secured on the shaft 90 at the rear part thereof. A belt 93 is wound around the gear 92 and around the sprocket 57 of the sprocket body 55 through an intermediate guide member 93*a* turnably mounted on the machine frame 1. A connecting rod 94 is at one end in contact with the inner face 71*a* of the dial member 71 and is at the other end connected to the projection 51*j* of the holding plate 51. The rod 94 is at one end thereof pressed against the inner face of the dial member 71 by means of the tension spring 54.

The releasing action of the followers 30, 31 will be explained with reference to FIGS. 1, 2, 12, 14, 15 and 26. FIGS. 12B and 26 show a condition in which the followers 30, 31 are pressed against the corresponding cams of the packed cams 20. When the dial 73 is rotated in the clockwise or counter-clockwise direction, the releasing cam body 64 is rotated accordingly, and the unit of the releasing plate 46, holding lever 47 and the releasing arm 48 is rotated in the clockwise direction around the follower shaft 7 against the action of the tension spring 52, and the projection 48*a* of the releasing arm 48 turns the lateral extension 25 of the U-shaped plate 23 and the projection 26*a* of the engaging element 26 on the U-shaped plate 24 (see FIGS. 4 and 6) in the clockwise direction against the action of respective springs (not shown) to disengage the followers 30 and 31 from the respective cams. In the meantime, the arm 47*a* of the holding lever 47 which acts on the engaging portion 51*e* of the holding plate 51, on turning of this holding plate 51 around the pin 50*a* in the counter-clockwise direction, moves along the engaging portion 51*f*. In this position the follower 46*a* of the releasing plate 46 engages the highest point of the cam 76 of the releasing cam body 64 — see FIG. 9. Further rotation of the dial 73 causes the follower 41*a* of the releasing plate 46 to pass the high point of the cam 76.

When the follower 46*a* comes to the lowest portion of the cam 76, the arm 47*a* of the holding lever 47 engages the engaging portion 51*g* of the holding plate 51 by the action of the tension spring 52. Thus the follower 30 and the follower 31 are held spaced from the cams 20.

Figure 12A:
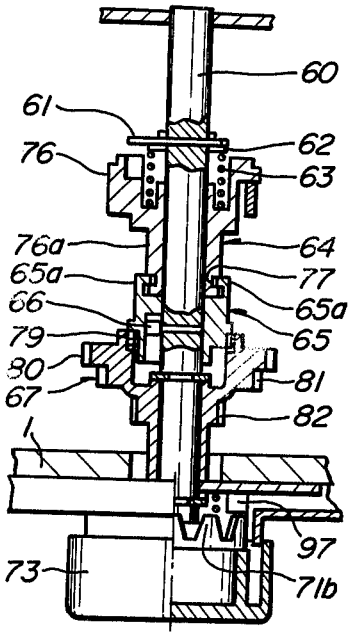
FIG. 12(A) is a sectional view of an operating device of this invention showing a condition in which the cam followers are spaced from the pattern cams.
Figure 12B:
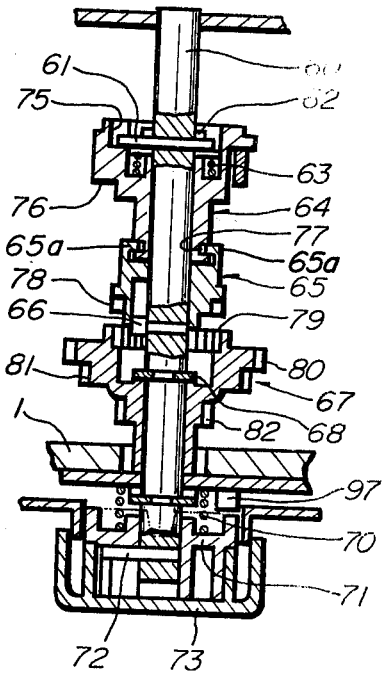
FIG. 12(B) is a sectional view of the operating device of this invention showing a condition in which the cam followers are engaged with the pattern cams.
Figure 13:
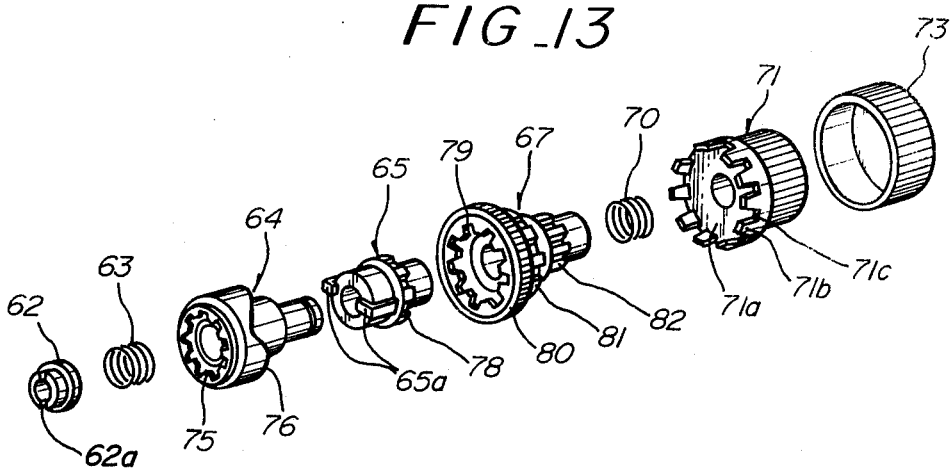
FIG. 13 is an exploded perspective view of an operating part of the operating device.

When the follower 46*a* of the releasing plate 46 engages the lowest portion of the cam 76, and therefore ceases to bear on the cam 76 in a direction away from the dial 73 the releasing cam body 64 is axially moved toward the dial 73 together with the clutch member 65 by means of the compression spring 63, until it is spaced from the pin 61 on the dial shaft 60 as shown in FIG. 12A. Therefore, rotating movement of the dial shaft 60 is not transmitted to the releasing cam body 64. Simultaneously, the projections 78 of the clutch member 65 engage the radial grooves 79 of the rotary body 67 which is under the influence of the leaf spring 83 in FIG. 1. Accordingly when the dial 71 is rotated the rotary body 67 is rotated via the clutch member 65, and therefore the pattern indicator 85 on the belt 84 is shifted. The rotation of the rotary body 67 causes the guide shaft 8 to rotate via the gear 80, small gear 91. Belt 93 and sprockets 92, 57 and to shift the follower 30 and the follower 31 along the follower shaft 7 for selecting desired cams.

The manual operation for engaging the followers 30, 31 with the selected cams will be explained with reference to FIGS. 7, 8, 12, 14 and 15. If the dial 73 is pushed against the compression spring 70, the holding plate 51 is turned in the counter-clockwise direction through the intermediate rod 94 against the action of tension spring 54. Then the unit of releasing plate 46, the holding lever 47 and releasing arm 48 is turned in the counter-clockwise direction by the action of the tension spring 52. Therefore the arm 47*a* of the holding lever 47 moves along the engaging portions 51*g*–51*f* of the holding plate 51 as shown in dot-dash lines in FIG. 15, and the arm 47*a* engages the engaging portion 51*e* of the holding plate 51 again as illustrated in solid lines in FIG. 14. Since the projection 48*c* of the releasing arm 48 is thus turned in the counter-clockwise direction in FIG. 26, the U-shaped plates 23, 24 are allowed to turn in the counter-clockwise direction by the action of the respective springs (not shown) acting on the U-shaped plates 23, 24. Thus the follower 30 and the follower 31 are engaged with the selected cams 20. At the same time, the releasing cam body 64 and the clutch member 65 are returned to the position as shown in FIG. 12B against the action of the compression spring 63 by the follower 46*a* of the releasing plate 46 which is under the influence of the tension spring 52 which is stronger then the action of the compression spring 63. It is to be noted that the indexing cam 81 of the rotary body 67 has the same number of divisions as redial grooves 75 of the releasing cam body 64.

The dividing phases of the indexing cam 81 of the rotary body 67 meet those of the grooves 71*c* of the dial member 71. In other positions than those of alignment between the indexing cam 81 of the rotary body 67 and the teeth 71*b*, one of the projections 71*b* of the dial member 71 is blocked by the pin 97 when the dial is pushed.

Automatic recovering of the followers 30, 31 from the position in which the followers are spaced from the cams 20 to the position in which the followers engage the selected cams will now be explained.

Figure 16:
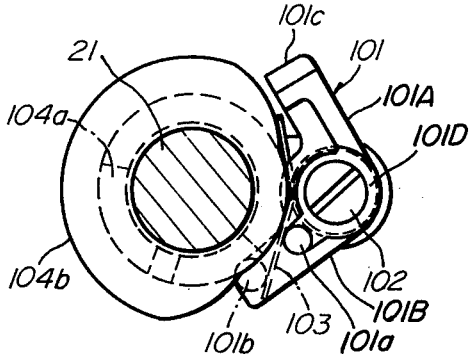
FIGS. 16 to 22 are explanatory views of an automatic recovering device of this invention.
Figure 17:
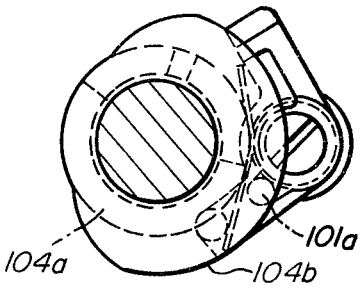
Figure 18:
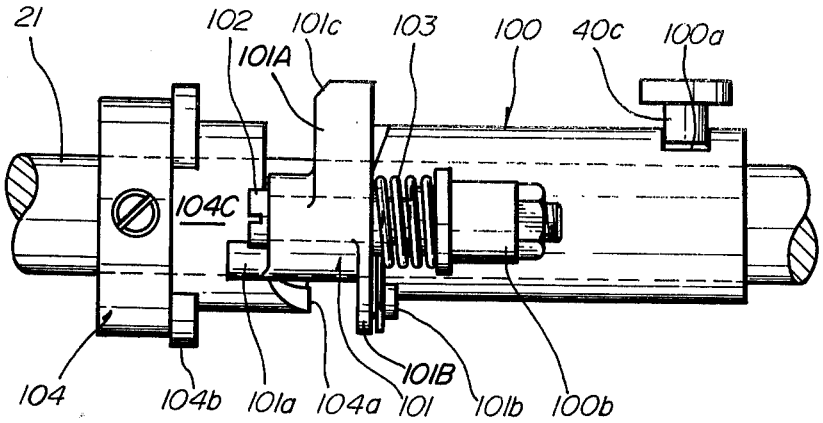

In FIGS. 16–23, an actuating body 100 is mounted on the upper shaft 21 of the sewing machine, and is movable only in the axial direction. The actuating body is provided with a groove 100*a* on the right side part thereof as shown in FIG. 18. The groove is engaged by the depending pin 40*c* of the actuating lever 40 as illustrated in FIGS. 6 and 26. A pawl member 101 having a central boss 101D an upper arm 101A and a lower arm 101B is turnably mounted on a shaft 102 secured to the boss 100*b* of the actuating body 100. The upper arm 101A has an engaging face 101*c* on one side and an engaging face 101*d* on the other side thereof. The central boss 101D has a lateral projection 101*a* on one side thereof as illustrated, and the lower arm 101B has a lateral projection 101*b* on the side opposite the lateral projection 101*a* of the boss 101D. A torsion spring 103 is mounted around the shaft 102, and contacts the actuating body 100 at one end thereof and engages the lateral projection 101*b* of the pawl member 101 at the other end thereof. Thus the pawl member 101 is biased in the clockwise direction in FIGS. 16 and 17 in such a manner that the lateral projection 101*a* rides on a cylinder 104C of cam member 104 which is described hereinafter.

Figure 15:
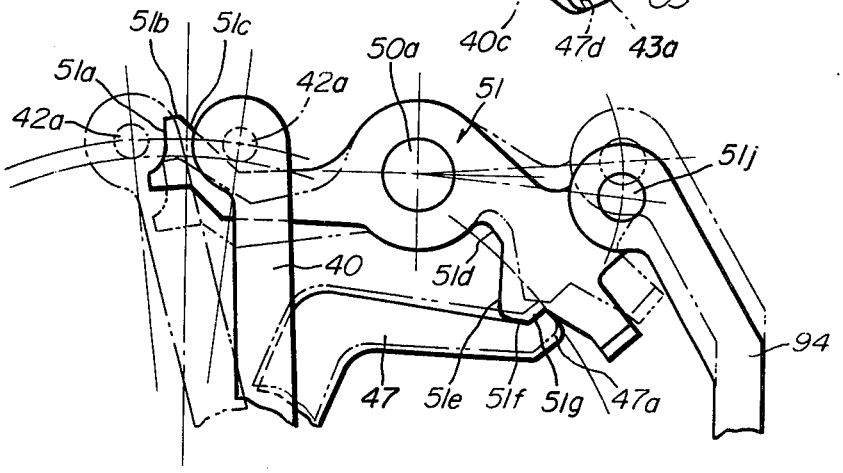
Figure 19:
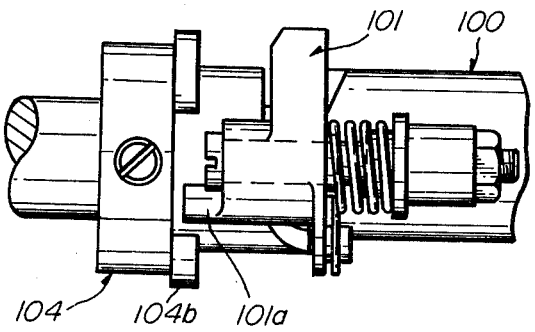
Figure 20:
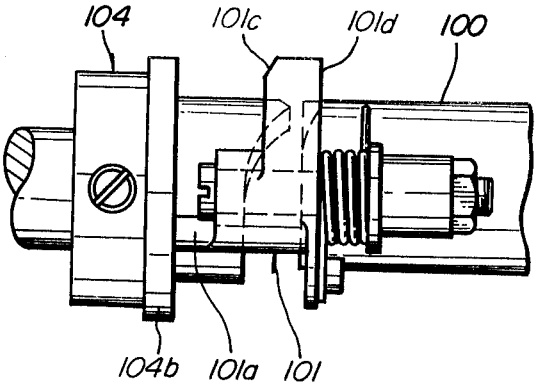
Figure 21:
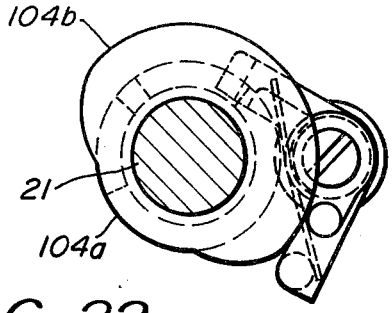
Figure 22:
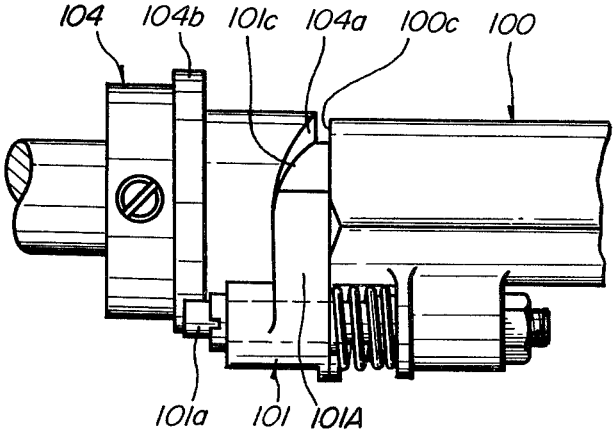
Figure 23:
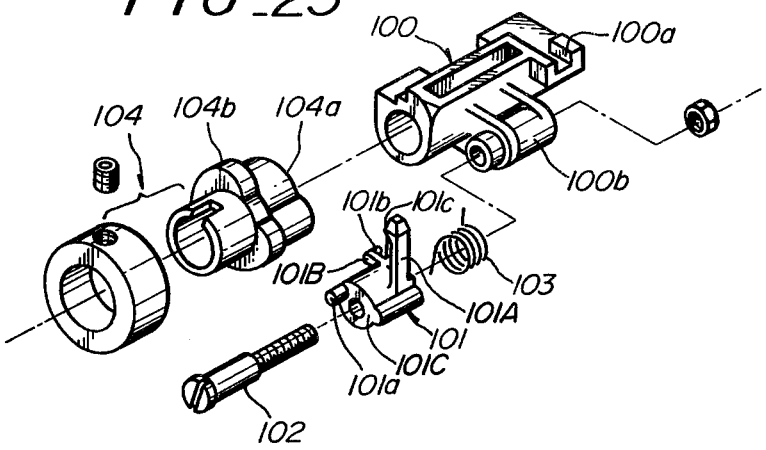
FIG. 23 is an exploded perspective view of the automatic recovering device.
Figure 24:
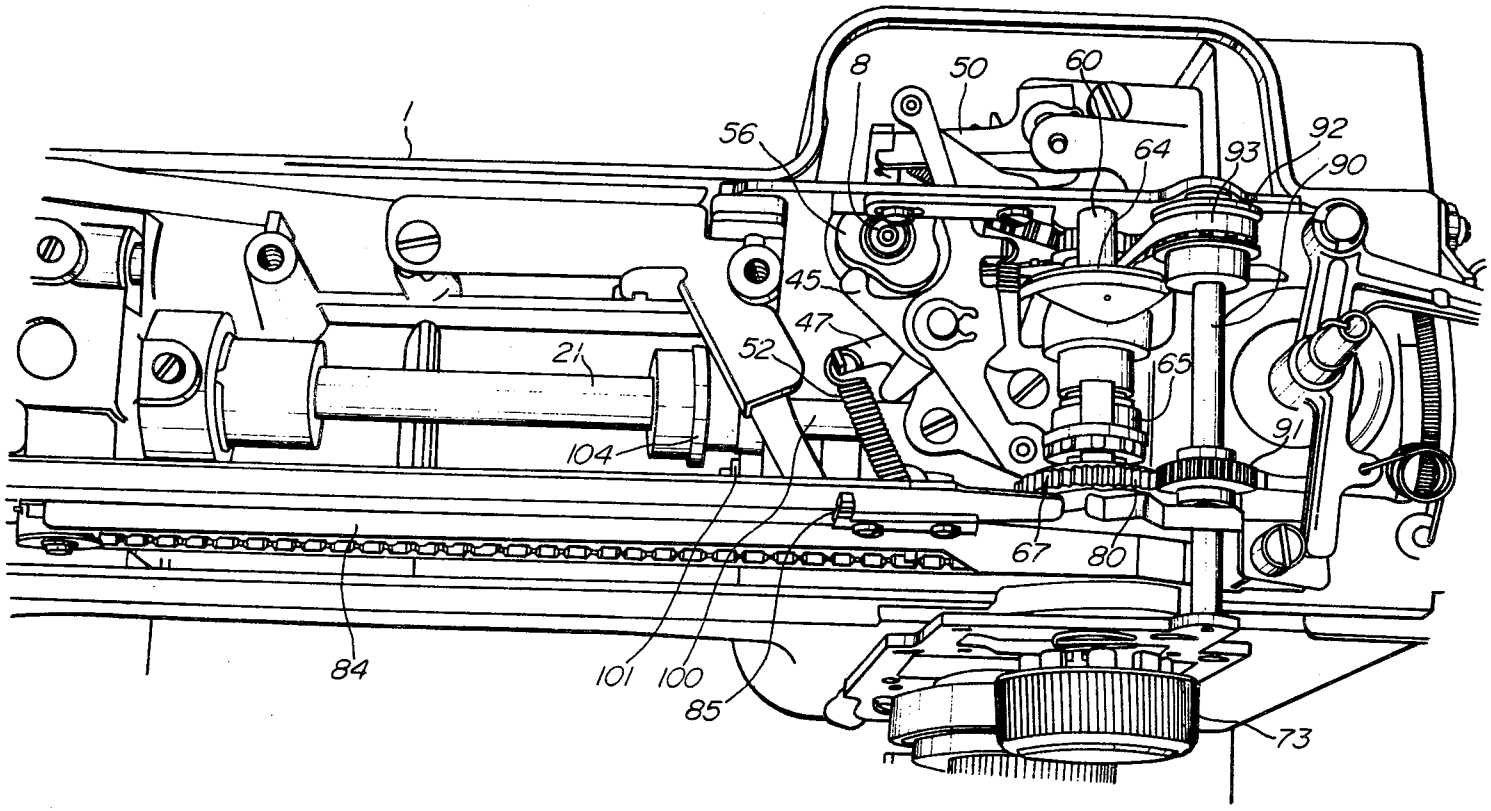
FIGS. 24 and 25 are perspective views of the device of this invention provided in the sewing machine.
Figure 25:
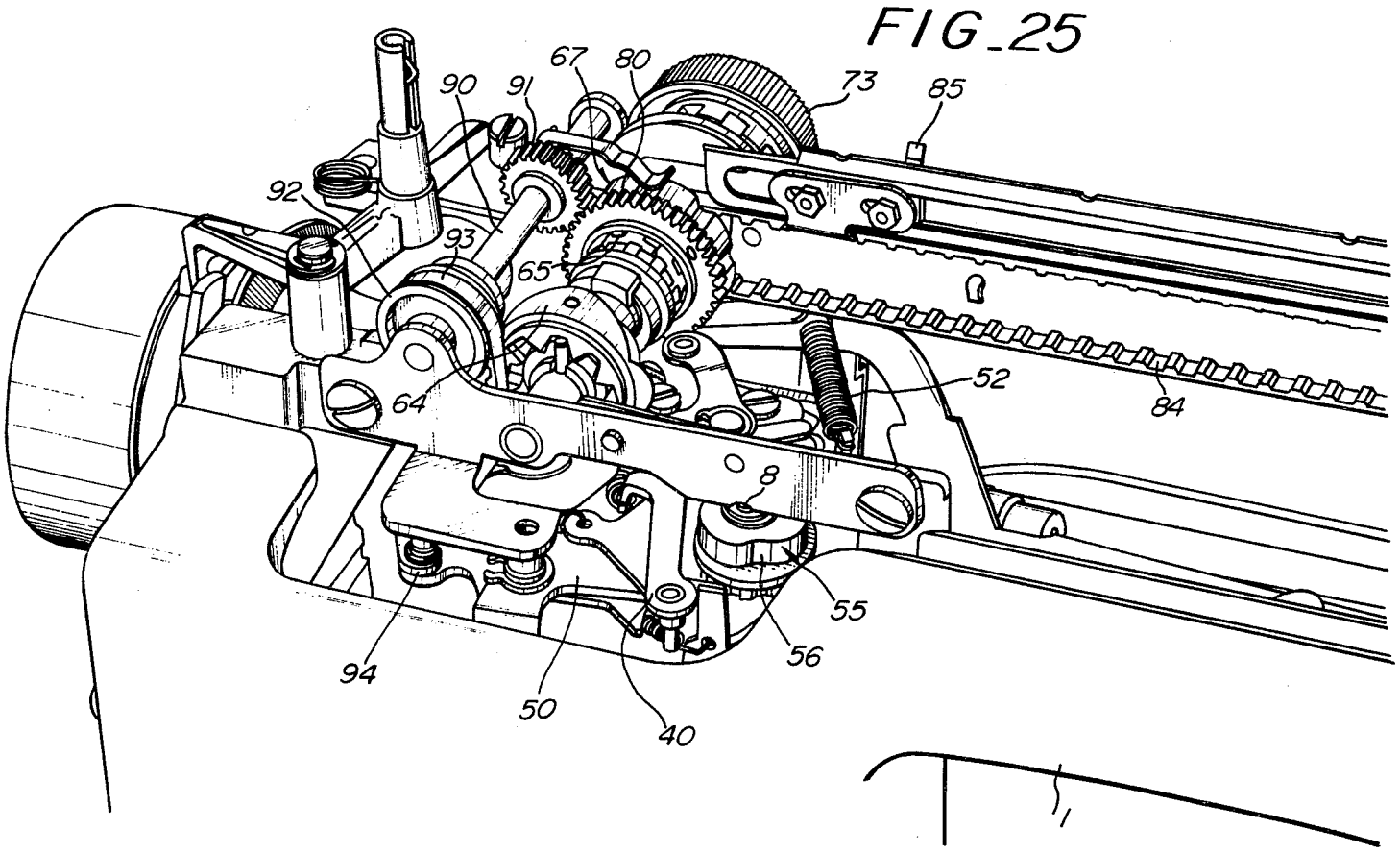

A cam member 104 is fixedly mounted on the upper shaft 21 of the sewing machine. The cam member 104 is adapted to cooperate with the pawl member 101 and has cam face 104*b* and a cylinder 104C having a cam face 104*a*. When the followers 30, 31 engage the cams 20, the actuating body 100 is in a position most remote from the cam member 104, and the arm 101B of the actuating pawl 101 is spaced from the side cam 104*a* of the actuating cam 104 and the lateral projection 101*a* is spaced from the cam 104*b* as shown in FIG. 18. In this instance, the dial 73 and the associated parts are in the condition as shown in FIG. 12(B). If the dial 73 is rotated, the releasing cam body 64 turns the unit of the releasing plate 46, releasing arm 48, holding arm 47 and actuating arm 40, and as the result the followers 30, 31 are held in the respective positions spaced from the cams 20 in the manner as described above. In the meantime, as the holding plate 51 is turned in the counter-clockwise direction by the tension spring 54 as shown in FIGS. 14 and 26, the pin 42*a* of the actuating lever 40, which has been in engagement with the engaging part 51*a* of the holding plate 51, is disengaged from the engaging part 51*a*, and then the actuating lever 40 is turned in the clockwise direction by means of the tension spring 53 until its pin 43*a* engages the engaging part 47*d* of the holding lever 47 as illustrated in FIGS. 14 and 15. The pin 40*c* of the actuating arm 40 is fitted in the groove 100*a* of the actuating body 100, and therefore when the actuating arm 40 is rotated in the clockwise direction, the actuating body 100 is moved in the axial direction toward the actuating cam 104. When the outer cam 104*b* of the actuating cam 104 is positioned, for example, as shown in FIGS. 16 and 18 so that the lowest part of the cam 104*b* is in the axial shifting path of the projection 101*a*, the pawl member 101 on the actuating body 100 is moved in full stroke, and the lateral projection 101*a* is moved into the rotation path to the cam 104*b* as shown in FIG. 19. When the cam 101*b* is positioned as shown in FIG. 17 in which the higher part of the cam 101*b* is positioned in the axial shifting path of the projection 101*a*, axial shifting of the projection 101*a*, and accordingly of the actuating body 100 is blocked in half way by the side of the cam 101*b* against the action of the spring 103 as shown in FIG. 20 until the lowest part of the cam 101*b* comes into axial alignment with the projection 101*a* as the upper shaft 21 of the sewing machine is rotated as shown in FIG. 19. When the upper shaft 21 of the sewing machine is driven in such a condition in the clockwise direction in FIG. 21, the cam 104*b* engages the projection 101*a* of the pawl member 101 as shown in FIG. 22 and turns the pawl member 101 in the counter-clockwise direction against the spring 103 in FIG. 21. Thus the upper arm 101A of the pawl member 101 is positioned between the cylinder cam 104*a* and the actuating body 100 as shown in FIGS. 21 and 22. As the upper shaft 21 further rotates, then the cylinder cam 104*a* engages the engaging part 101*c* of the pawl member 101 and shifts the pawl member 101 and accordingly the actuating body 100 to the right.

Thus, the actuating body 100 is moved to the right to rotate the actuating arm 40 in the counterclockwise direction in FIG. 15 and accordingly the pin 42*a* of the actuating lever 40 turns the holding plate 51 in the counterclockwise direction around the pin 50*a* as the pin 42*a* engages the engaging part 51*c* of the holding plate 51. In the meantime, the unit of the releasing plate 46, the holding lever 47 and the releasing arm 48 are turned in the counterclockwise direction by the tension spring 52. Therefore, the arm 47*a* of the holding lever 47 is moved along the engaging parts 51*g*, 51*f*, 51*e* and to the engaging part 51*d* of the holding plate 51 as shown in the imaginary lines in FIGS. 14 and 15. In the meantime, the dependent projection 48*c* of the releasing arm 48 in FIGS. 6, 26 and 27 is moved to allow the U-shaped plates 23, 24 to turn in the counterclockwise direction. Thus, the followers 30, 31 are released to engage the selected cams. In the meantime the follower 46*a* of the releasing plate 46 pushes the cam 76 of the cam body 64 in FIG. 14. Thus, the dial mechanism in the condition of FIG. 12A is returned to the condition in FIG. 12B.

I claim:

1. In a sewing machine wherein a drive shaft rotates relative to the machine frame in order vertically to reciprocate a needle and to rotate a pack of pattern cams, and wherein a cam follower is displaceable along said pack and engageable with each of said cams for controlling the stitch pattern of the needle, the improvement comprising:

selector means operable for displacing said follower along said pack of cams;

actuating means connected to said follower for displacing same from an engaged position riding on a one of said cams into a disengaged position clear of said cams and displaceable along said pack;

operating means including an operator element displaceable in a predetermined manner and connected to said selector means and to said actuating means for displacement of said cam follower into said disengaged position on displacement of said operator element in said manner and then displacement of said cam follower along said pack on continued displacement of said operator element in the same manner;

holding means connected to said follower for retaining same in said disengaged position after displacement of same by said actuating means through said operator element into said disengaged position; and releasing means connected to said follower for displacing same from said disengaged position into said engaged position.

2. The improvement defined in claim 1, further comprising transmission means connected on one side to said operator element and connectable on the other side alternatively to said selector means and to said actuating means for connection of said operator element only to said actuating means on commencement of displacement of said operator element in said predetermined manner and for subsequent connection only to said selector means on continued displacement of said operator element in said predetermined manner.

3. The improvement defined in claim 2 said operating means includes a pointer and means connecting said pointer to said operator element for displacement of said pointer with said element and indication of pattern.

4. The improvement defined in claim 2 wherein said operator element is a dial and said operating means includes a dial shaft rotatable in said frame and carrying said dial, whereby displacement in said predetermined manner is rotation of said dial.

5. The improvement in claim 4 wherein said actuating means includes a control cam carried on said dial shaft and rotatable therewith.

6. The improvement defined in claim 5 wherein said transmission means includes a clutch on said control shaft displaceable by said dial cam between a disengaged position decoupling said shaft and said selector means and an engaged position coupling said dial shaft to said selector means.

7. The improvement defined in claim 6 wherein said actuating means includes a control follower on said frame engageable axially of said dial shaft with said control cam, said holding means being connected to said control follower.

8. The improvement defined in claim 1 wherein said releasing means is connected to said drive shaft for displacing said follower into said engaged position on rotation of said shaft.

9. The improvement defined in claim 8 wherein said releasing means includes a release cam carried on said shaft and mechanism engaging between said release cam and said actuating means for displacing said follower into said engaged position on rotation of said shaft only in a predetermined angular position of said shaft in said frame.

10. The improvement defined in claim 1 wherein said predetermined manner is exclusively angular displacement of said operator element about an axis on said frame.

11. The improvement defined in claim 1, further comprising a pack of feed-control cams aligned with said pattern cams, and a feed control follower engageable with said feed-control cams and jointly pivotal with the pattern-cam follower on said frame.

12. The improvement defined in claim 1, wherein said selector means includes a selector element displaceable along said pack of cams, and at least one spring between said selector element and said follower and normally defining a predetermined position for said follower relative to said selector element but permitting limited movement of said follower relative to said selector element.

13. The improvement defined in claim 1 wherein said operator element is a dial rotatable on said frame and said releasing means is operated by depression of said dial on said frame, said releasing means including stops on said frame for preventing depression of said dial in positions not corresponding to alignment of said follower with a pattern cam.

14. In a sewing machine wherein a drive shaft rotates relative to the machine frame in order vertically to reciprocate a needle and to rotate a pack of pattern cams, and wherein a cam follower is displaceable along said pack and engageable with each of said pattern cams for controlling the stitch pattern of said needle, the improvement comprising:

selector means operable for displacing said cam follower along said pack of pattern cams;

actuating means connected to said cam follower for displacing same from an engaged position riding on a one of said pattern cams into a disengaged position clear of said cams and displaceable along said pack;

operating means including a displaceable operator element connected to said selector means and to said actuating means for displacement of said cam follower into said disengaged position and then displacement of said cam follower along said pack on displacement of said operator element in a predetermined manner;

holding means connected to said cam follower for retaining same in said disengaged position after displacement of same by said actuating means through said operator element into said disengaged position; and releasing means including a release cam carried on said drive shaft and mechanism engaging between said release cam and said actuating means for displacing said cam follower into said engaged position on rotation of said drive shaft only in a predetermined angular position of said drive shaft in said frame, said releasing means including a pivotal plate and a spring urging said plate out of a pivoted position corresponding to said engaged position of said cam follower, said holding means including a pivotal pawl engageable with said plate to hold same in said pivoted position, said mechanism being connected to said pivotal pawl for operating same.

15. The improvement defined in claim 14 wherein said mechanism includes a collar longitudinally displaceable on said drive shaft and jointly displaceable with said pawl, said mechanism including a release follower engageable between said release cam and said collar in a predetermined angular position of said release cam relative to said frame.

16. In a sewing machine wherein a drive shaft rotates relative to the machine frame in order vertically to reciprocate a needle and to rotate a pack of pattern cams, and wherein a cam follower is displaceable along said pack and engageable with each of said pattern cams for controlling the stitch pattern of the needle, the improvement comprising:

selector means operable for displacing said cam follower along said pack of pattern cams;

actuating means including a control cam connected to said cam follower for displacing same from an engaged position riding on a one of said pattern cams into a disengaged position clear of said pattern cams and displaceable along said pack;

operating means including a dial shaft carrying said control cam and rotatable in said frame and a dial carried thereby and connected to said selector means and to said actuating means for displacement of said cam follower into said disengaged position and then displacement of said cam follower along said pack on rotation of said dial and dial shaft, said actuating means including a control follower on said frame engageable axially of said dial shaft with said control cam;

holding means connected to said cam and control followers for retaining said cam follower in said disengaged position after displacement of same by said actuating means through said dial into said disengaged position, said holding means including a pivotal pawl having edges engageable with said control follower to hold same in a position corresponding to said disengaged position of said cam follower;

releasing means connected to said cam follower for displacing same from said disengaged position into said engaged position; and transmission means connected on one side to said dial and connectable on the other side alternatively to said selector means and to said actuating means for connection of said dial only to said actuating means on commencement of rotation of said dial and for subsequent connection only to said selector means on continued rotation of said dial, said transmission means including a clutch on said dial shaft displaceable by said control cam between a disengaged position decoupling said dial shaft and said selector means and an engaged position coupling said dial shaft to said selector means.

17. The improvement defined in claim 14 wherein said releasing means includes mechanism for pivoting said pawl away from said follower of said control cam.

18. The improvement defined in claim 17 wherein said dial is axially limitedly displaceable on said dial shaft and said mechanism is axially engaged with said dial for pivoting of said pawl on axial displacement of said dial.

19. The improvement defined in claim 16 wherein said actuating means includes spring biasing means for urging said follower toward said patterns cams.

* * * * *